US005315798A

United States Patent [19]

Zarwell

[11] Patent Number: 5,315,798

[45] Date of Patent: May 31, 1994

[54] COMBINED WINDOW AND VENT UNIT

[76] Inventor: Daniel W. Zarwell, 1296 N. 64th St., Wauwatosa, Wis. 53213

[21] Appl. No.: 849

[22] Filed: Jan. 5, 1993

[51] Int. Cl.[5] ..... E06B 3/32; E05D 1/06

[52] U.S. Cl. ..... 52/202; 52/204.51; 52/204.64; 49/67; 49/389; 49/400; 49/463

[58] Field of Search ..... 52/204.51, 204.64, 206, 52/207, 202, 204.51, 204.7; 49/61, 62, 67, 463, 389, 391, 400

[56] References Cited

U.S. PATENT DOCUMENTS

| | | | |
|---|---|---|---|
| 710,661 | 10/1902 | Berger | 49/389 |
| 961,726 | 6/1910 | Mayr | 49/62 |
| 1,186,361 | 6/1916 | Alexander | 49/67 |
| 1,201,615 | 10/1916 | O'Flynn | 49/67 |
| 2,032,126 | 2/1936 | Hankins | 49/389 |
| 3,002,556 | 10/1961 | Tourville | 49/67 |

FOREIGN PATENT DOCUMENTS

| | | | |
|---|---|---|---|
| 39481 | 10/1909 | Austria | 49/67 |

*Primary Examiner*—Michael Safavi
*Attorney, Agent, or Firm*—Quarles & Brady

[57] ABSTRACT

A combined window and vent unit which is vandal resistant yet is versatile in its ventilation and insulation capabilities. There is a freely movable window panel which is positioned in a rigid frame structure without the use of any hinge members yet can be retained therein in an intermediate ventilating position. The frame structure for the vent unit is easily assembled and the panel members and screening can be easily repaired.

7 Claims, 2 Drawing Sheets

FIG. 1
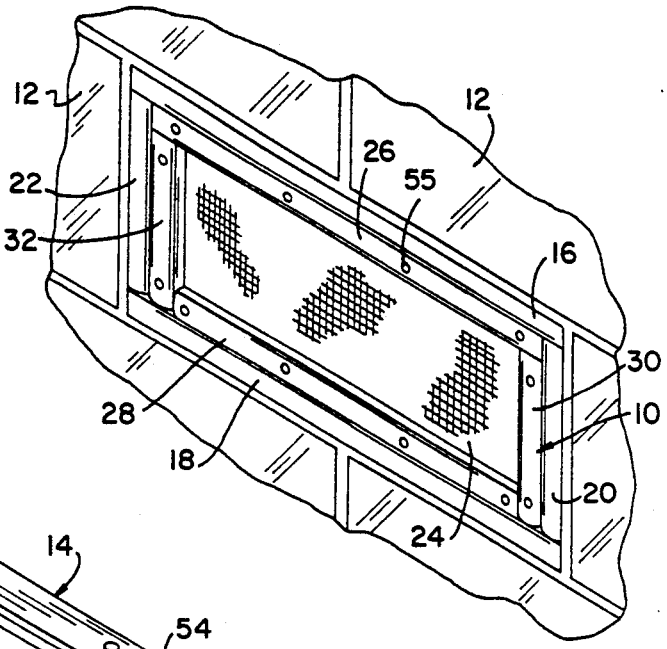
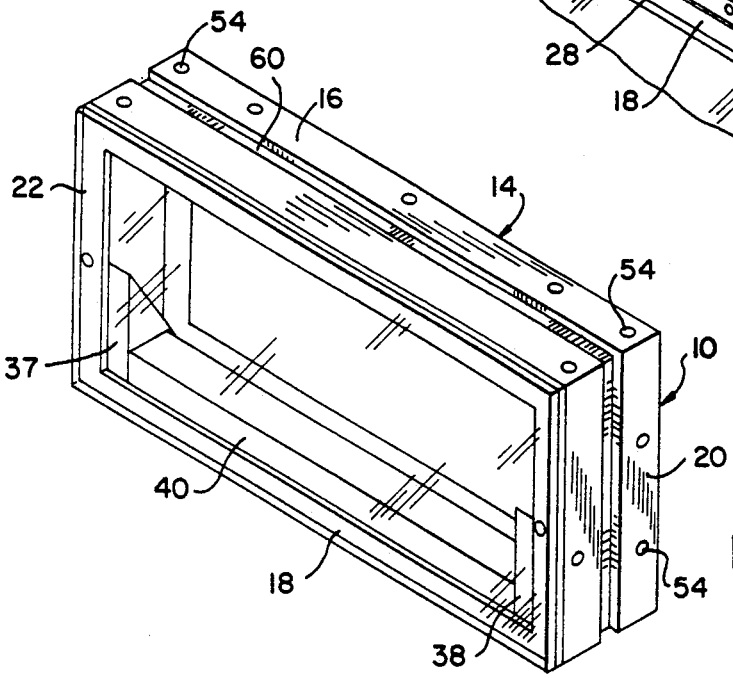
FIG. 2
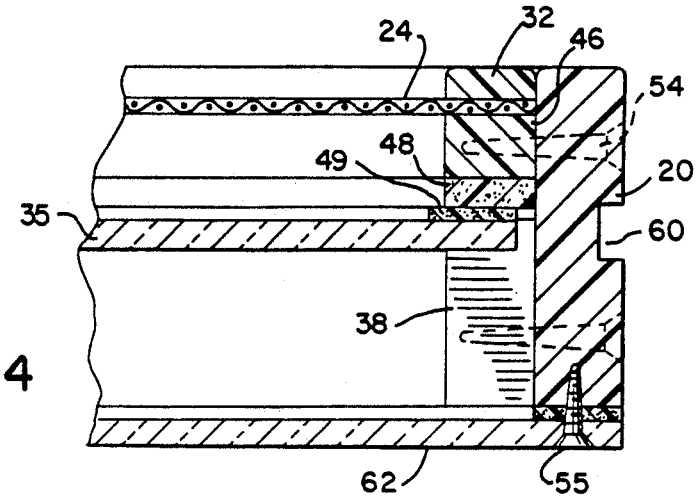
FIG. 4

FIG. 3
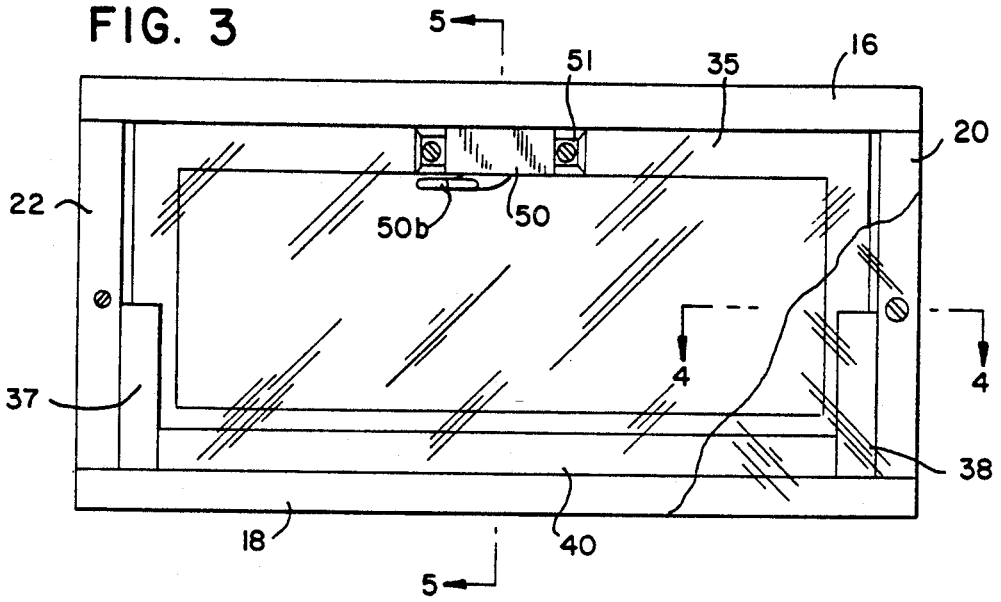
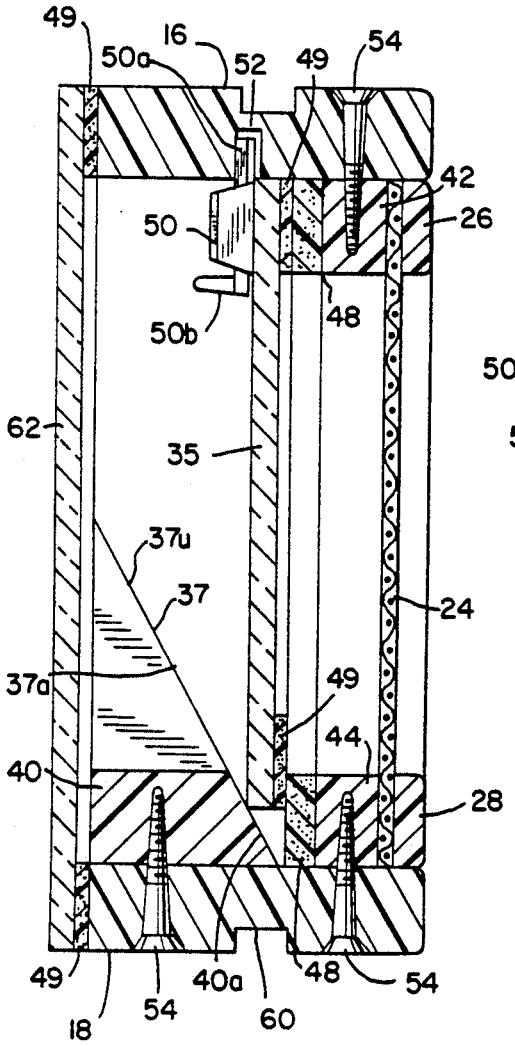
FIG. 5
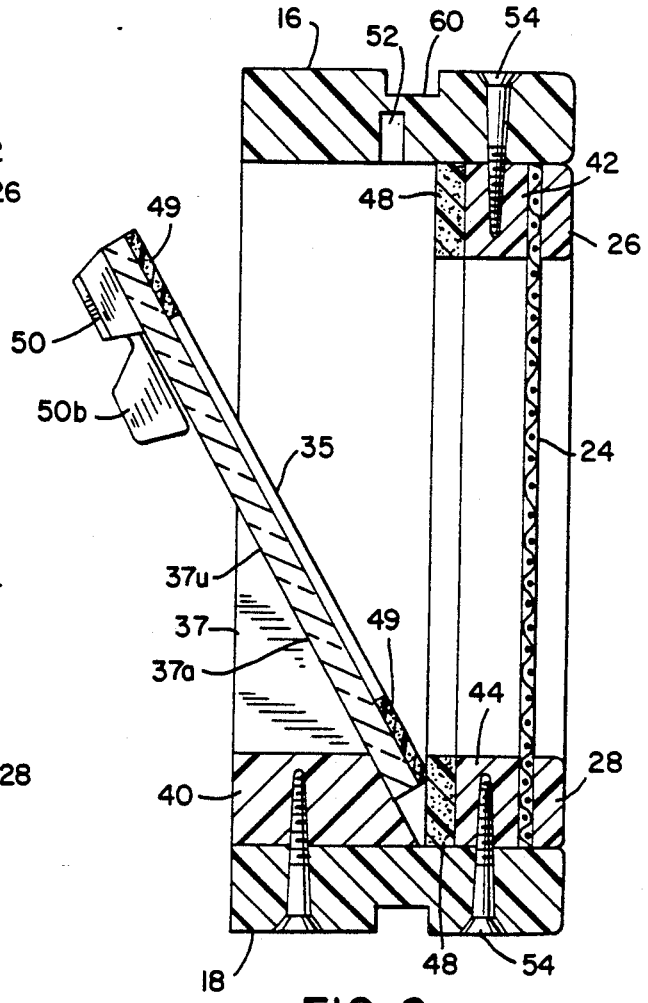
FIG. 6

COMBINED WINDOW AND VENT UNIT

BACKGROUND OF THE INVENTION

This invention relates to a vent unit and more particularly to a simplified window and vent unit which can be used in various structures such as windows and walls.

There are readily available various types of assemblies which are employed to provide a venting of indoor rooms to the outside atmosphere. These assemblies involve numerous moving and connected parts such as hinged panel members which include articulated hinging structures. These multicomponent structures pose problems when they need to be repaired as is often the case because of vandalism. Neither do the prior venting assemblies provide the structural durability so that they can be placed in buildings where there is a high incidence of vandalism. Additionally, current vent structures because of their construction from metal do not afford desired insulation capabilities. They are also costly having been made with several components which need to be assembled in a precise manner.

The prior art does not provide a window and vent unit which is simple in construction yet can afford adjustment in ventilating capacity. Neither does the prior art provide a window and vent unit which has a high insulation value and is weather proof. The prior art is also deficient in affording a combined window and vent unit which can be manufactured from recycled materials.

It is an object of the invention to provide a combined window and vent unit which is simplified in its construction.

It is another object of this invention to provide a combined window and vent unit which is damage resistant and can be easily repaired.

It is yet another object of the invention to provide a combined window and vent unit of the foregoing type which has a high insulation value and is watertight.

It is still another object of the invention to provide a combined window and vent unit of the foregoing type which can be manufactured from recycled materials.

It is an additional object of the invention to provide a window and vent unit which is adaptable to various ventilation requirements including the removal of a window panel.

It is yet an additional object of the invention to employ an inclined plane as a compression hinge for a window panel.

Other objects include a combined window and vent unit which has the versatility for use in a wall or glass block panels as well as can be fabricated with few parts and without special tooling.

SUMMARY OF THE INVENTION

The foregoing objects are accomplished and the disadvantages of the prior art are overcome by the present combined window and vent unit which has a first frame structure including top and bottom wall and side wall members; a second frame structure is positioned inside the first frame. These are angular guide surfaces positioned adjacent the side walls and sloping downwardly toward the bottom wall, the guide surfaces terminating in a preselected distance from the second frame. A window panel member is freely carried by the first frame structure and between the angular guide surfaces and the second frame structure. The angular guide surfaces provide support for the panel member when in a venting position.

In one embodiment there are latch means associated with the panel member and the first frame structure.

In a preferred embodiment, an additional window panel is attached to a back surface of the first frame structure.

In another preferred embodiment, the combined window and vent unit is fabricated from recycled materials.

In one aspect insulative means is positioned between the panel member and the second frame structure.

In another aspect, the combined window and vent unit is adapted to be accommodated by glass block in a panel structure.

In yet another aspect, a screen member is connected to a front portion of the unit.

BRIEF DESCRIPTION OF DRAWINGS

FIG. 1 is a front view of the combined window and vent unit of this invention shown in a glass block panel structure.

FIG. 2 is a top perspective view from the back of the combined window and vent unit shown in FIG. 1.

FIG. 3 is a back view in elevation with a portion broken away showing the vent unit of FIG. 1.

FIG. 4 is a view in cross-section taken along line 4—4 of FIG. 3.

FIG. 5 is a view in cross-section taken along line 5—5 of FIG. 3.

FIG. 6 is a view similar to FIG. 5 except showing a window panel in an alternative position.

DESCRIPTION OF THE PREFERRED EMBODIMENTS

Referring to FIGS. 1 and 2, the combined window and vent unit is shown generally at 10 in conjunction with glass block panels 12 providing a window. It includes a frame generally 14 composed of an upper bar member 16, a lower bar member 18 and opposing side bar members 20 and 22 to provide top and bottom as well as side wall portions. There is a screen member 24 which is secured inside frame 14 by the upper and lower bars 26 and 28 and the side bars 30 and 32 in a manner to be later explained.

Referring to FIGS. 3 and 4, there is shown a window panel 35 which is disposed inside the guide blocks 37 and 38 and the base block 40 as well as an inner frame. The inner frame is composed of an upper bar 42, a lower bar 44 and two interconnecting side bars, one of which is shown at 46 and the other (not shown) would be placed inside and spaced from side bar 22 to form a rectangular frame. Adhesive insulating strips 48 are placed over the inner frame members such as 42, 44 and 46 as well as over the border of window panel 35 as seen at 49.

A latch mechanism 50 is connected to window panel 35 by means of the screws 51. It has a hand actuated lever **50*b* for retracting the biased projection 50*a*. There is a slot 52 in the upper bar member 16 for receiving the projection 50*a* as seen in FIG. 5. This represents the closed position of the window panel 35. There it is seen that the bottom portion of the window panel 35 rests against the angled portion 40*a* of base block 40. Accordingly, it will also rest against the lower portion of angled surface 37*a* of guide block 37 as well as that of guide block 38**.

It should be appreciated that when the window panel 35 is initially placed against the angled portion **40*a*** and angled surfaces such as 37*a* of guide block 37 and that of guide block 38, these provide an inclined plane for panel 35 to result in a compression type hinge at the bottom of the panel 35 and an air tight seal with respect to insulating strips 48 and 49. This hinge effect is afforded without connection between the bottom of the panel and the guide blocks 37 or 38 or any frame structure.

FIG. 6 represents the window panel 35 in a partially open position. There it is seen that the panel 35 is resting against upper angled portion 37*u* of angled surface 37*a*. It should be noted that with the window panel 35 in the angled position, it is easily removed from the frame 15 as it is freely carried therein and only attached by the latch mechanism 50.

Referring back to FIG. 5, it is seen that an additional window panel 62 is attached to the back of frame 14 by the screws 55. An insulation stripping 49 is also placed between the panel 62 and the frame 14 as composed in part by the upper and lower bar members 16 and 18. This is an optional feature as it provides an additional security as well as an insulation feature.

One method of fabricating the combined window and vent unit is from the previously described bars 16, 18, 20 and 22 composing frame 14 and bars such as 42, 44 and 46 which compose in part the inner frame. These are fastened together by the screws 54. In a similar manner, the guide blocks 37 and 38, as well as the base block 40, are fastened to bar members 18, 20 and 22. The screening 24 is fastened to the inner frame by the bars 26, 28, 30 and 32 by the screws 55.

While this is seen as the best mode for constructing the combined window and vent unit at this time, obviously other methods such as extrusion molding the frames and subsequently fastening them together can be employed or cast molding the two frames together as well as the base and guide blocks 40 and 37, 38, respectively.

The bar members as well as the guide blocks are all composed of recycled plastic which in this instance is plastic obtained from recycled plastic milk bottles. This contributes to substantial cost reduction and meets government regulations for use of 30% recycled materials.

An important feature of the combined window and vent unit 10 is its durability as can be seen from the previous description of its fabrication. All of the frame components are securely held in place making it very difficult to be vandalized. For example, once set in place such as being surrounded by the glass block panels 23 with mortar engaging the groove 60 on the vent unit 10, it is highly resistant to any movement. Vent unit 10 measures 15½ inches and 7½ inches at its outer dimension and 12¼ inches and 4½ inches at its inner dimension. Thus making it highly resistant to entry should the screening 24 and the window panels 35 and 62 be removed.

Other important features are the simplicity of components and the high insulation or "R" value. The high "R" value is accomplished by the two window panels 35 and 62 wherein the latter acts as a storm window. Double insulation is provided between panel 35 and the inner frame, and insulation is afforded for panel 62. The double insulation between panel 35 and the inner frame also affords a watertight unit. The window panel 35 is devoid of any hinges and freely removable. Should it be damaged, it can easily be replaced as can the screening 24 by removing the bar members 26, 28, 30 and 32. Window panel 62 is also easily replaced.

The combined vandal resistant and insulation features make the vent unit especially suitable for the following applications: rest rooms, taverns, service stations, housing projects, summer cottages, high crime or vandalism areas. As salt and water resistant materials are employed to fabricate the vent unit, it is especially suitable for southern and costal environments.

Two window panels 35 and 62 have been described for the vent unit 10. Obviously, panel 62 could be eliminated although the insulation valve would not be as high. The same is true with respect to the elimination of the insulation strips. Screening 24 could also not be employed or could be placed on the outside of the outer frame 14.

While the vent unit 10 has been preferably depicted in a rectangular configuration, it is susceptible to other geometric configurations such as square or trapezoidal. Various sizes can also be accommodated. Any suitable plastic, wood or metal building materials can be utilized although recycled plastic is preferred from an environmental standpoint.

Although the vent unit finds a special adaption in conjunction with glass block panels, it can be advantageously employed in any suitable wall structure such as brick, cement block or wood.

The foregoing invention can now be practiced by those skilled in the art. Such skilled persons will know that the invention is not necessarily restricted to the particular embodiments presented herein. The scope of the invention is to be defined by terms of the following claims as given meaning by the preceding description.

I claim:

1. A combined window and vent unit comprising:
   - a first frame structure including top and bottom wall and side wall portions;
   - a second frame structure positioned inside the first frame;
   - combined angular guide and support surfaces positioned adjacent the side wall portions and sloping downwardly toward the bottom wall, said guide surfaces terminating in a preselected distance from the second frame;
   - a window panel member freely carried by the first frame structure and between the angular guide surfaces and the second frame structure; and
   - insulative means connected to at least one of the panel member and the second frame structure;
   - whereby the angular guide surfaces provide support for the panel member when in a venting position and a compressive hinging action between the insulative means of the panel member and the second frame structure when in a closed position.

2. The combined window and vent unit of claim 1 further including latch means operatively associated with the panel member and the first frame structure.

3. The combined window and vent unit of claim 1 further including an additional window panel member for attachment to a back surface of the first frame structure.

4. The combined window and vent unit of claim 1 wherein the first and second frame structures are fabricated from recycled plastic materials.

5. The combined window and vent unit of claim 1 wherein the first frame structure is constructed and arranged to be accommodated in a glass block panel structure.

6. The combined window and vent unit of claim 1 wherein the angular guide surfaces are defined by laterally disposed guide block members and an interconnected base block member.

7. The combined window and vent unit of claim 1 wherein a screen member is connected to a front portion of the unit.

* * * * *